US010537158B2

(12) United States Patent
Swan

(10) Patent No.: US 10,537,158 B2
(45) Date of Patent: Jan. 21, 2020

(54) SUPPORT DEVICE

(71) Applicant: Georgie Mark Reginald Swan, Essex (GB)

(72) Inventor: Georgie Mark Reginald Swan, Essex (GB)

( * ) Notice: Subject to any disclaimer, the term of this patent is extended or adjusted under 35 U.S.C. 154(b) by 0 days.

(21) Appl. No.: 16/281,343

(22) Filed: Feb. 21, 2019

(65) Prior Publication Data

US 2019/0183214 A1 Jun. 20, 2019

Related U.S. Application Data

(62) Division of application No. 13/981,426, filed as application No. PCT/EP2012/051258 on Jan. 26, 2012, now abandoned.

(30) Foreign Application Priority Data

Jan. 26, 2011 (GB) ..... 1101358.8

(51) Int. Cl.

| | |
|---|---|
| ***A44C 17/00*** | (2006.01) |
| ***A44C 7/00*** | (2006.01) |
| ***A44C 15/00*** | (2006.01) |
| *A41D 13/08* | (2006.01) |

(52) U.S. Cl.

CPC ..... *A44C 7/003* (2013.01); *A44C 15/003* (2013.01); *A44C 15/0035* (2013.01); *A41D 13/087* (2013.01); *A44C 7/009* (2013.01); *Y10T 24/41* (2015.01)

(58) Field of Classification Search

CPC ... A44C 7/003; A44C 15/003; A44C 15/0035; A44C 7/009; Y10T 24/41; A41D 13/087

USPC ..... 63/12, 13

See application file for complete search history.

(56) References Cited

U.S. PATENT DOCUMENTS

| | | | |
|---|---|---|---|
| 2,525,195 | A | 10/1950 | Austrin et al. |
| 3,191,824 | A | 6/1965 | Burr |
| 3,238,938 | A | 3/1966 | Jurgovan |
| 3,500,829 | A | 3/1970 | Abramowitz |
| 4,974,430 | A | 12/1990 | Turner |
| 4,993,240 | A | 2/1991 | Pounder |
| 5,044,176 | A | 9/1991 | King |
| 5,097,682 | A | 3/1992 | Nakamura |

(Continued)

FOREIGN PATENT DOCUMENTS

| | | | |
|---|---|---|---|
| GB | 433886 | A | 8/1935 |
| GB | 613532 | A | 11/1948 |

(Continued)

OTHER PUBLICATIONS

International Search Report and Written Opinion dated Apr. 25, 2012 for corresponding PCT Application No. PCT/EP2012/051258. Machine translation of JP 2011050540.

*Primary Examiner* — Jack W Lavinder

(74) *Attorney, Agent, or Firm* — Renner, Otto, Boisselle & Sklar, LLP

(57) ABSTRACT

A support device for transferring at least part of the weight of an earring from an earlobe to a part of the ear that comprises cartilage, the device comprising a first portion (P1') capable of being attached to the earlobe and a second portion (P2') protruding from the first portion and capable of, when the first portion is attached to the earlobe, extending from the earlobe to attach to the part of the ear comprising cartilage.

17 Claims, 10 Drawing Sheets

(56) References Cited

U.S. PATENT DOCUMENTS

| | | | | |
|---|---|---|---|---|
| 5,444,994 | A | 8/1995 | Poorting | |
| 5,611,333 | A | 3/1997 | Johnson | |
| 5,809,803 | A * | 9/1998 | Stracuzzi | A44C 7/009 63/12 |
| 6,003,333 | A | 12/1999 | Stevens | |
| 6,409,059 | B1 | 6/2002 | Calvert | |
| 8,657,063 | B2 | 2/2014 | Lederman | |
| 2005/0257805 | A1 | 11/2005 | Williams | |
| 2006/0081003 | A1 | 4/2006 | Machock | |

FOREIGN PATENT DOCUMENTS

| | | | |
|---|---|---|---|
| JP | 2011050540 | A | 3/2011 |
| WO | WO-9738601 | A1 | 10/1997 |
| WO | WO-2009149773 | A1 | 12/2009 |

* cited by examiner

SUPPORT DEVICE

CROSS-REFERENCE TO RELATED APPLICATIONS

This application is a divisional application of U.S. patent application Ser. No. 13/981,426, filed on Sep. 8, 2014 entitled "SUPPORT DEVICE," which is a national stage application (under 35 U.S.C. § 371) of PCT/EP2012/051258, filed Jan. 26, 2012, which claims benefit of English Application No. 1101358.8, filed Jan. 26, 2011, the entirety of which is herein incorporated by reference.

The present invention relates to a support device for earrings.

An earring is a piece of jewelry that is commonly worn through a piercing in the ear lobe. Over time, the weight of the earring may bear on the piercing, potentially tearing and/or stretching the ear lobe. The ear lobe can become distended. This effect is particularly pronounced when the earring is heavy.

There are several products currently on the market that are aimed at mitigating the lobe stretching effect of earrings (such as "Lobe Wonder" and "Ear Lift", for example). However, these products only redistribute some of the weight placed on the piercing to a section to the earlobe. This limited support is often inadequate for addressing problems caused by wearing heavy jewelry.

Other products that try to deal with the issue are described in DE2004014318, U.S. Pat. Nos. 4,974,430, 5,537,841, 5,638,701, 5,769,995, 6,003,333 and 5,638,701. The products described in these applications also redistribute some of the weight on the piercing to the earlobe.

Although the devices disclosed in these applications are targeted towards mitigating the problem of ear lobe stretching, they all assume that the ear lobe is strong enough to carry the weight of the earring. However, this is not always the case.

There is therefore a need for a device that mitigates the effect of earlobe stretching.

SUMMARY OF THE INVENTION

According to a first aspect of the present invention, there is a support device for transferring at least part of the weight of an earring from an earlobe to a part of the ear that comprises cartilage, the device comprising a first portion capable of being attached to the earlobe and a second portion protruding from the first portion and capable of, when the first portion is attached to the earlobe, extending from the earlobe to attach to the part of the ear comprising cartilage.

The first portion may have a higher tensile strength than the second portion.

The support device may comprise an adhesive layer for attaching the first portion to the earlobe and the second portion to the part of the ear comprising cartilage.

The support device may be formed of a self-adhesive material.

The first portion may be sized so as to cover one or more piercings in a user's earlobe.

The first portion may comprise a preformed hole. The preformed hole may have a diameter less than 1 mm.

The first portion may be formed of a material capable of being pierced by an earring post.

The support device may be capable of being inserted into an ear via a surgical procedure.

According to a second aspect of the present Invention, there is an applicator configured to be positioned behind an earlobe by a user wishing to insert an earring through a piercing in the earlobe, the applicator comprising a protective pad configured to, when the applicator is positioned behind the earlobe, abut against the earlobe such that a post of an earring inserted through the piercing will press against the protective pad, the applicator thereby being capable of preventing an earring post from injuring a user.

The protective pad is preferably formed of a material capable of being deformed by an earring post pressed against it.

A surface of the protective pad may comprise a plurality of raised bumps.

The applicator may comprise a handle that protrudes from the protective portion and which is configured to be grasped between two or more digits of the user's hand.

The applicator may comprise a glove-like portion configured to be mounted on a digit of the user's hand.

According to a third aspect, there is a support device substantially as herein described with reference to the accompanying figures.

According to a fourth aspect, there is an applicator substantially as herein described with reference to the accompanying figures.

For a better understanding of the present invention, reference is made by way of example to the following drawings, in which.

Figure 3:
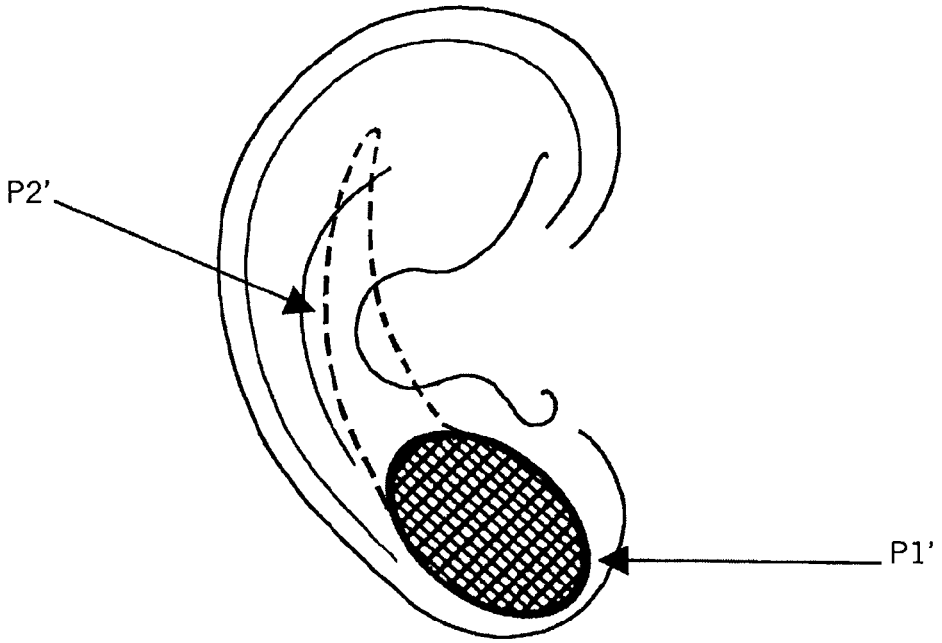

FIG. 3 also illustrates an embodiment of the support device in relation to a user's ear.

Figure 4A:
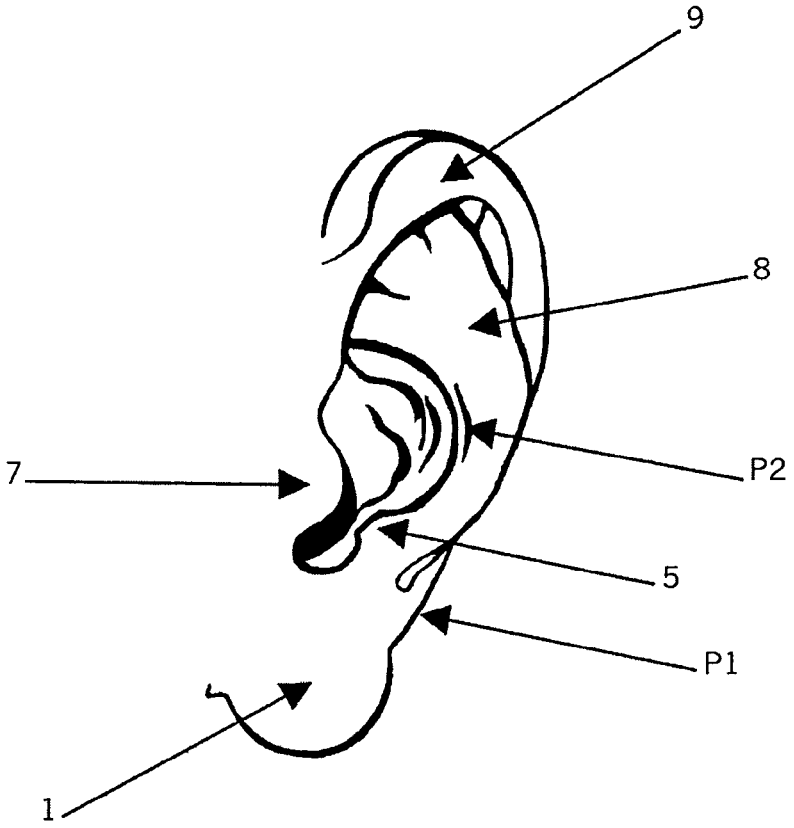

FIG. 4A illustrates the structure of the ear as viewed from the front side.

Figure 4B:
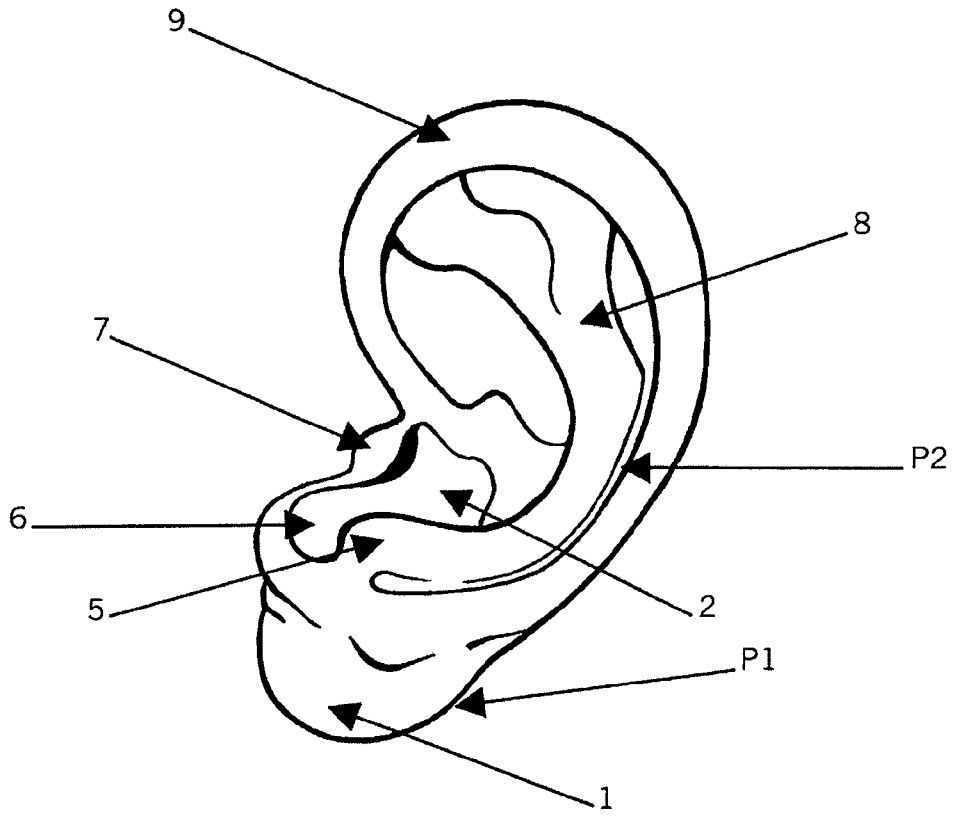

FIG. 4B illustrates the structure of the ear as viewed from the front.

Figure 4C:
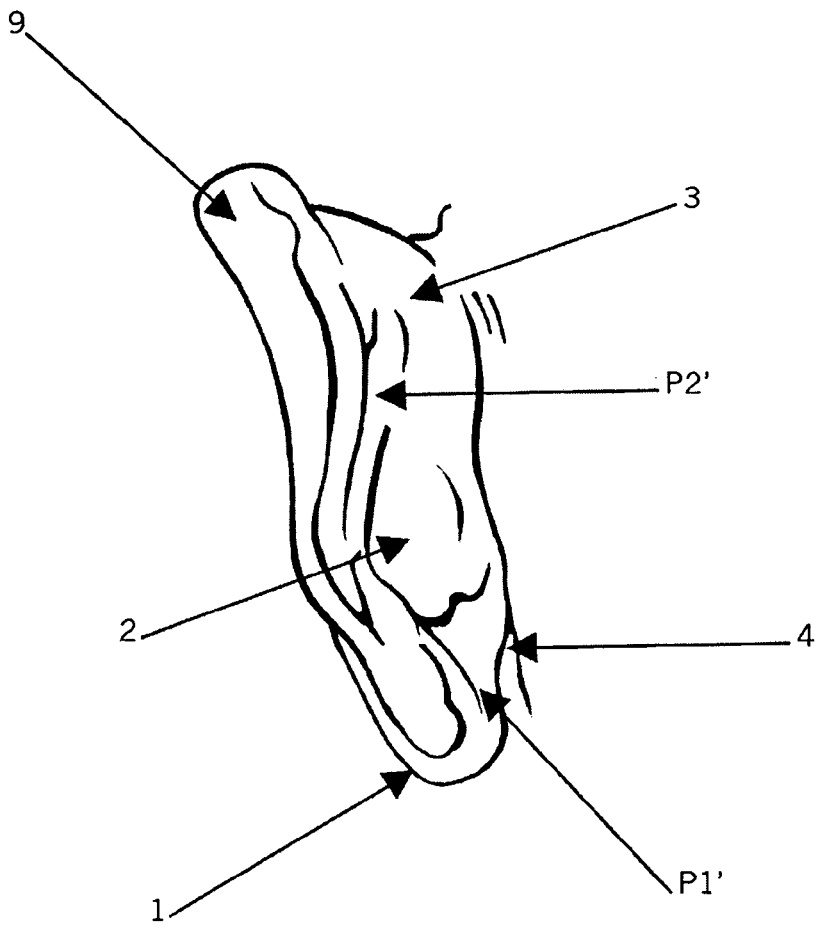

FIG. 4C illustrates the structure of the ear as viewed from the back side.

Figure 5:
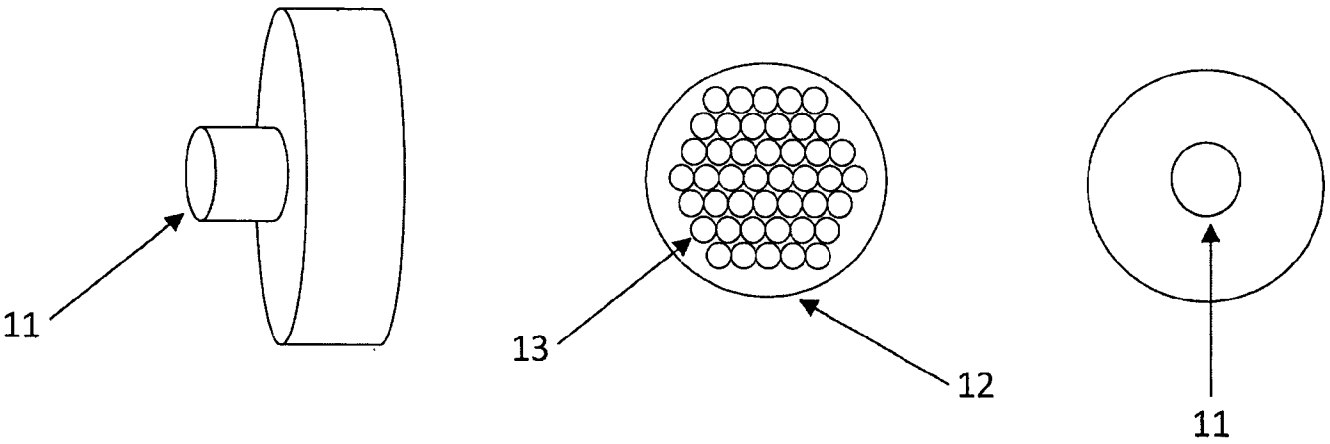

FIG. 5 illustrates an embodiment of an applicator.

Figure 6:
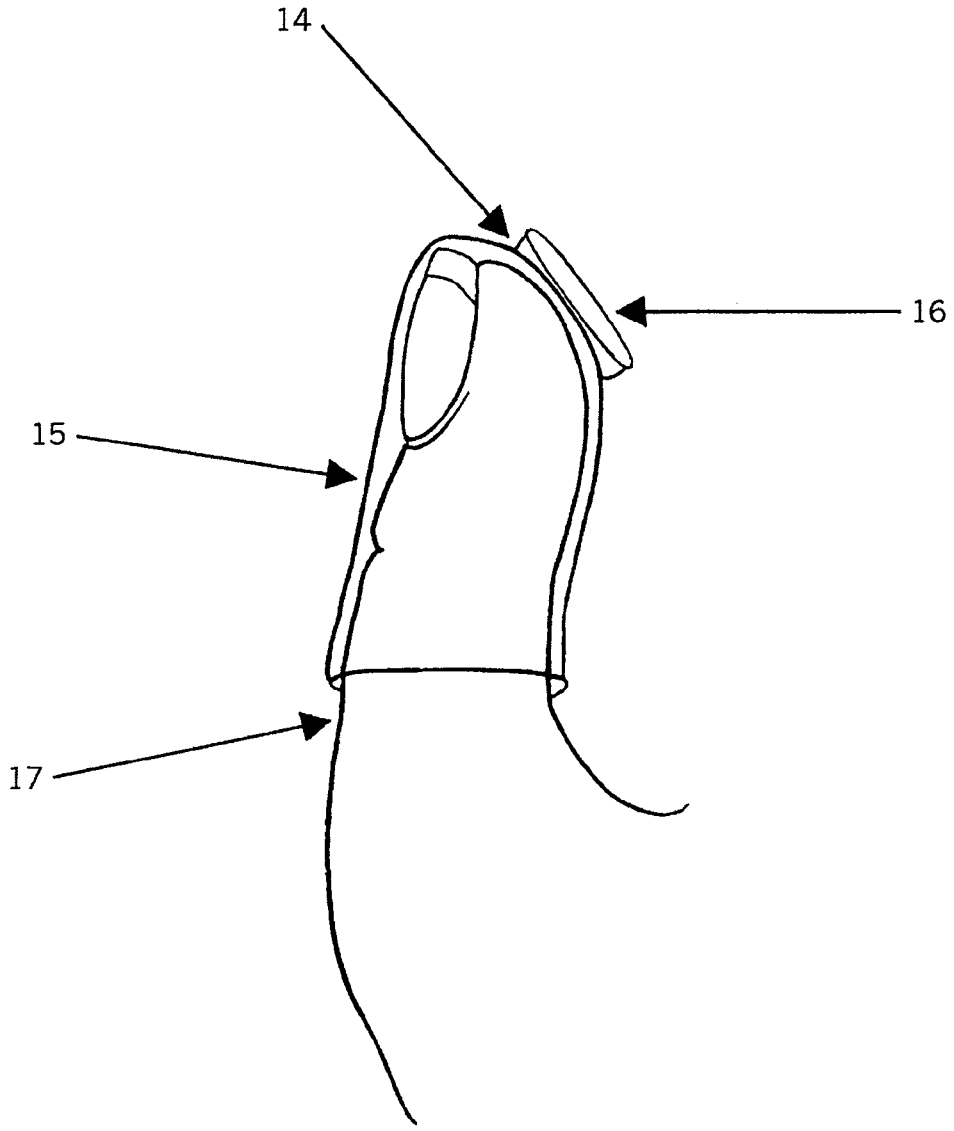

FIG. 6 illustrates an embodiment of an applicator.

Figure 7:
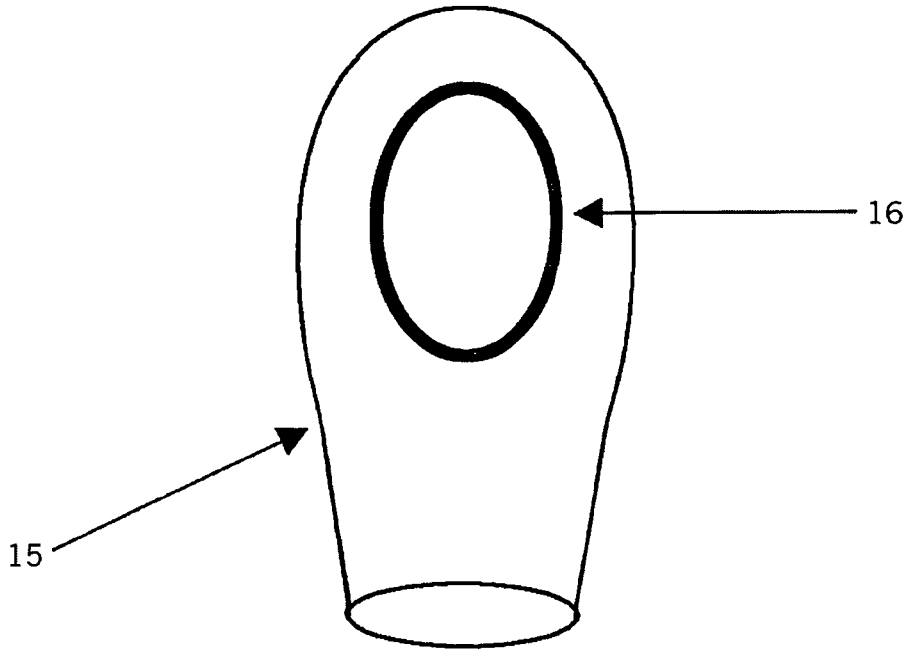

FIG. 7 illustrates an alternative view of the applicator of FIG. 6.

The following reference numerals will be used throughout the following description to refer to parts of the ear:

1 Lobule
2 Concha
3 Rear of the Anti-helix
4 Crease at the bottom of the lobe
5 Antitragus
6 Intertragic notch
7 Tragus
8 Antihelix
9 Helix The structure of the external ear is illustrated in FIGS. 4A to 4C. The external ear includes the auricle, the ear canal and the outermost layer of the ear drum (also called the tympanic membrane). The majority of the auricle is formed of a skeleton of resilient elastic cartilage thinly covered with skin. Cartilage is generally stiffer and less flexible than muscle. The auricular cartilage skeleton is formed of a single piece of cartilage. Its shape determines the general shape of the ear, including the concha, tragus, antitragus, helix and antihelix. The auricular cartilage skeleton does not extend to the lobule (or 'ear lobe'), which is instead formed of soft fibrofatty tissues (such as areolar and adipose tissues). The soft tissue of the earlobe lacks the strength of the auricular cartilage.

A support device for supporting the weight of earrings is described below. The support device is configured to transfer at least part of the weight of an earring from an earlobe to a part of the ear that comprises cartilage. The support device comprises a first portion capable of being attached to the earlobe and a second portion protruding from the first portion and capable of, when the first portion is attached to the earlobe, extending from the earlobe to attach to the part of the ear that comprises cartilage. The support device is thus capable of utilising the strength and firmness of the cartilage to support at least part of the weight of the earrings. The disclosed support device helps to mitigate the stretching effect of heavy earrings on the ear lobe. The support device may be implemented as an external support device. The support device might also be implemented as an internal support device.

The support device offers four main functions:

1. Cosmetic improvements to the image of the ear lobe.
2. Support to minimise unsightly sagging/tearing of the ear lobe/piercing hole.
3. Comfort when wearing ear jewelry of any size, drop and/or weight.
4. Prevention and protection from damage to the ear lobe (or further damage to already damaged earlobes), from wearing ear jewelry and any other adverse affects when wearing earrings in all walks of life.

The support device is suitable for earring wearers of both genders.

The support device can be used in a variety of circumstances. The support device may be used daily. The support device may be worn on special occasions. The support device may further be worn whilst the user is playing sports or performing any type of physical exertion.

Figure 1:
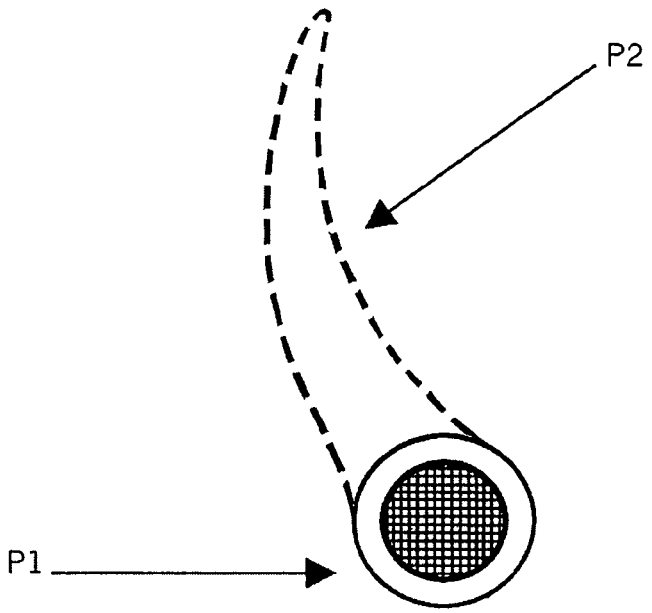
FIG. 1 illustrates an embodiment of the support device.

A support device according to one embodiment of the invention has the structure illustrated in FIG. 1. The support device has a first portion P1 that is designed to adhere to the back of the ear. Preferably, the first portion is designed to adhere to the back of the earlobe 1. The first portion P1 is preferably sized to accept at least one earring. The first portion P1 may be sized such that, when in position, the first portion P1 is not visible when the front of the ear is viewed straight-on. The first portion may be substantially circular.

Figure 2A:
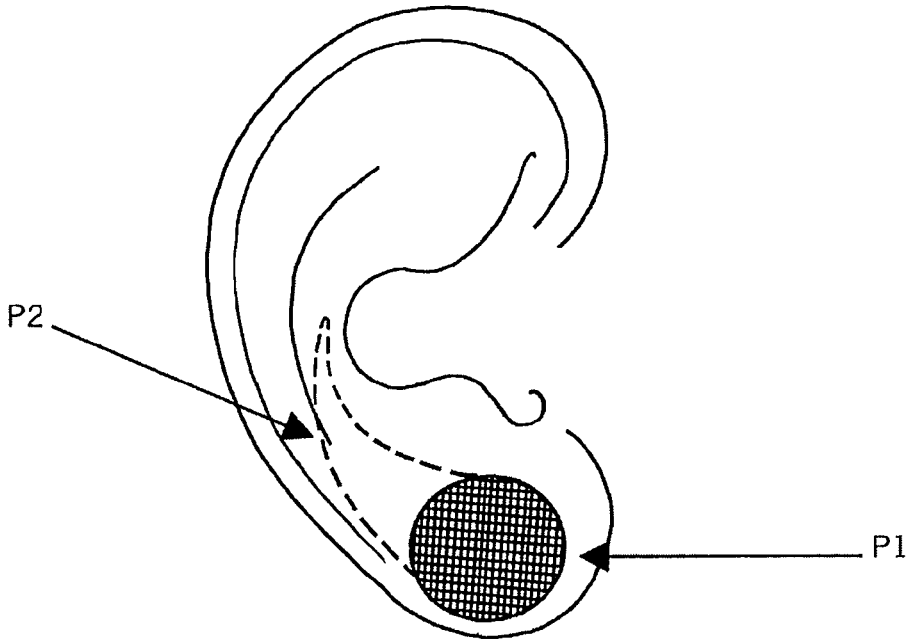
FIG. 2A illustrates an embodiment of the support device in relation to a user's ear.

The support device may comprise a second portion P2 that can also be adhered to the back of the ear. Preferably the second portion P2 protrudes from the first portion P1. The second portion may be designed to adhere to a part of the ear comprising the auricular cartilage skeleton. For example, the second portion may be configured to adhere to the rear of: the concha, the tragus, the antitragus, the helix or the antihelix. The second portion is preferably configured to adhere to the rear of the concha 2. An example of a support device in this position is illustrated in FIG. 2A.

Preferably the first and second portions of the support device each have an adhesive surface for attaching the device to a user's ear. The adhesive surface is preferably a major surface of the respective portion. The second portion P2 is preferably flexible such that, in use, it can adapt to the shape of the ear.

The support device may overcome the deficiencies of the prior art as the lobule and the piercing in the lobule no longer bear the full weight of the earring. Instead, the support device may enable at least some of the weight of the earring to be supported by the parts of the auricle comprising cartilage, which has a greater tensile strength than the tissue of the lobule. In other words, at least part of the downwards drag exerted on the lobule by heavy earrings may be transferred by the support device to the auricular cartilage, which is better able to resist that force than the lobule. The described stretching of the lobule may therefore be lessened by use of the support device.

Figure 2B:
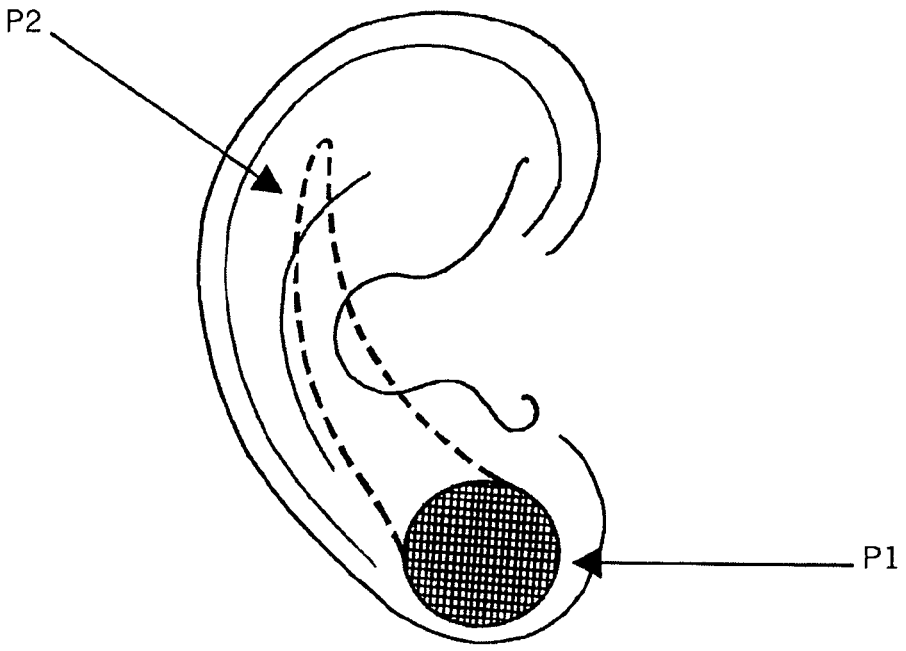
FIG. 2B illustrates a further embodiment of the support device in relation to a user's ear.

In cases of extremely heavy jewelry or long-drop earrings, it may be beneficial for the support device to adhere to a higher section of the ear than the concha 2. In such cases, it may be preferable for the second portion P2 to extend to the rear of the anti-helix 3. This scenario is shown in FIG. 2B, Preferably, the first portion P1 is shaped differently for use in different scenarios. For example, the shape and/or size of the first portion P1 may be altered depending on whether the user has single or multiple piercings in the lobe area. For multiple piercings, a support device similar to that illustrated in FIG. 3 may be suitable. In FIG. 3, the first portion P1' of the support device has been fashioned into a substantially oval shape. The oval covers a surface of the lower lobe 1 that is expected to receive multiple piercings. The oval is preferably designed to adhere to a larger area of the lower lobule than a first portion design for a single piercing.

The support device may be formed from a membrane. Therefore, the area of each of the major surfaces of the first and second portions may be much higher than the surface area of their respective minor surfaces. In other words, the support device may be similar to a membrane in that it can consist of a thin, pliable sheet of material. The membrane may be of non-uniform thickness. In particular, in some embodiments it is preferred that the first portion has a greater average thickness than the second portion. Similarly, the support device membrane may be formed from at least two different materials. In such an embodiment, the material(s) used to form the first portion is preferably of a greater tensile strength than the material(s) used to form the second portion. It is beneficial to manufacture the support device as a thin membrane-type structure as, for a given material or material combination, the device is rendered less obtrusive, more flexible and more lightweight than a thicker structure.

Preferably, the support device is made from an air permeable and micro porous material. Air permeable and micro porous materials allow the skin to breathe naturally and to excrete sweat.

The support device is preferably formed from a self-adhesive material. Preferably the self-adhesive material is hypo-allergenic. This reduces the likelihood of infection or irritation. An example of a suitable material is 3M Transpore 1527 or 1527S.

If a non-self-adhesive material is selected, the material may be made adhesive by deposition of a liquid adhesive. Preferably, the adhesive of the support device is sufficient for reliable fixation of the support device to the ear. The adhesive of the support device may be hypo-allergenic. Preferably, the material of the support device is such that, when the support device is removed, the adhesive remains with the support device. This is beneficial as hair may stick to any adhesive that remains when the support device is removed. The adhesive applied to the non-self-adhesive material may form an adhesive layer that is thicker than, thinner than or comparable to the thickness of the non-self-adhesive material.

A device suitable for swimmers may be manufactured from a waterproof material. Preferably, the adhesive used on a support device configured for swimmers is also resistant to both water and chlorine.

Although preferably both the first and second portions comprise an adhesive surface, the support device may be configured to have adhesive on the second portion only. In such a case, the support device only adheres to the ear over the auricular cartilage. Similarly, the support device may comprise at least two adhesives, with a stronger adhesive being used on the second portion.

Preferably, the support device is made from a transparent material. Using a transparent material allows the support device to be inconspicuous to the naked eye. However, it is also envisioned that coloured support devices may be used. The support device may be coloured in flesh tones or in any Pantone registered colour. Making the support device out of transparent materials enables the wearer to monitor the insertion of the earring when piercing the support device with the earring post. Preferably, the support device is made from a waterproof material.

Preferably, the first portion of the support device is has a higher tensile strength than the second portion. This may be beneficial because it is the lobule (to which the first portion attaches) that extends beyond the auricular cartilage and is most in need of the weight-bearing properties of the support device. The first portion might be manufactured from a material incorporating a woven mesh. The woven mesh might extend over the whole of the lower section P1 of the support device (see e.g. FIGS. 2A, 2B and 3) or only part thereof (see e.g. FIG. 1). Alternatively, the first portion may be made from the same material as the second portion, but may be thicker than the second portion.

The user could purchase the support device in pairs, or multiples thereof. Preferably the pairs of support devices, or multiples thereof, are provided on a carrier. Preferably the carrier performs the function of the removable backing (detailed further below).

Although it is envisaged that the support device is preferably a disposable device, it is understood that a person of skill in the art could create a re-usable support device with either a suitable adhesive or a suitable re-adhesive dispenser.

The support device may be arranged to be pierced by the earring post. If the first portion of the device includes a high density woven mesh structure, the earring post may be inserted between strands of the mesh. The support device may include one or more preformed holes for receiving an earring post. Preferably, any pre-formed holes are sized slightly smaller than the diameter of a standard earring post, e.g. the preformed holes are preferably 1 mm or less in diameter. The preformed holes may be 0.8 mm. Undersizing the pre-formed holes may reduce the weight borne by the piercing.

The support device could be applied to the back of the ear in a variety of ways, Some examples will now be given.

The support device could comprise a removable backing. Preferably the removable backing is a waxed backing. The waxed backing may be applied to the adhesive surface of the support device to minimise any loss of adhesion prior to application. The removable backing may be removed prior to the application of the support device to the ear. The backing could therefore function in a similar way to the backing of a plaster.

The support device may have at least two removable backings. Preferably, the first removable backing is removable from the first portion P1 of the support device to reveal the first adhesive surface. The first adhesive surface may be applied to the back side of the ear lobe, Preferably the first adhesive surface is positioned over the hole of the relevant piercing. Preferably, when the first adhesive surface is adhered to the back of the ear, the user has yet to insert the earring post into the hole of the relevant piercing. Once in place, the second removable backing can be removed. Preferably the second removable backing is removable from the second portion P2 to reveal a second adhesive surface. Preferably the second adhesive surface is applied to the back of the user's ear. The user may exert force on the support device to aid in fixing the device to the ear. This may be performed by the user's fingers. Preferably, the act of exerting force on the support device has the effect of adhering the support device to the back of the user's ear. Preferably, the earring is placed in the ear following the adhesion of the support device. Preferably, placing the earring in the ear causes the support device to be pierced.

In the alternative to applying the support device with the user's hands alone, the user may utilise a support device applicator. Examples of possible support device applicators are illustrated in FIGS. 5 to 7 and are later described.

The support device may further be configured as an internal support device. The internal support device may be inserted to the ear during a surgical procedure. Similar to the regular support device, described above, the internal support device surgical procedure also uses the ear's cartilage to support weight placed on the lobe.

Configuring the support device to be an internal device may provide a permanent solution to the problems of sagging of the ear lobules and tearing of the piercing hole/holes. Preferably, the operation to install an internal support device can be performed at the same time as an operation to repair, already torn/damaged ear lobules. Operations to reconstruct already torn or damaged ear lobules are known in the art (see e.g. U.S. Pat. No. 5,638,701)

The internal support device may be placed between the front and back layers of skin in the lobule. This situation is illustrated in FIGS. 4A to 4C. Preferably, the internal support device is placed in position through an incision in the crease 4 of the back of the lobule, where the ear joins the head (see FIG. 4C). It is preferable to insert the internal support device through an incision in the crease 4 of the back of the lobule 1. Inserting the device through an incision in the crease 4 of the back of the lobule 1 reduces the visibility of scarring.

The internal support device can be internally stitched to the anti-tragus 5 (see FIGS. 4A to 4C), the bottom of the concha 2, and/or to the tragus 7. Preferably, by stitching the internal support device to these places, the surgeon is able to pierce, or re-pierce, the ear lobe. Preferably, the internal support device is employed prior to the initial piercing to provide preventative support.

If the ear lobule is already torn or damaged, the torn/sagging ear lobule could be reconstructed over and around the internal support device. Preferably, the torn/sagging ear lobule is reconstructed during the same surgical procedure as the insertion of the internal support device.

The external support device may be applied to the ear with the aid of a support device applicator. Examples of possible support device applicators are illustrated in FIGS. 5 to 7.

The applicator may be used for reducing the likelihood of a user injuring themselves when inserting earring posts through a piercing. The applicator may be positioned to prevent the earring post from contacting the back of the user's head, neck and/or digits. The applicator may be especially useful where the user must apply force to get the earring post through the piercing. The applicator may therefore help protect a user who is re-piercing their ear. The applicator may further protect a user piercing a support device using an earring post.

An applicator may be configured to be positioned behind an earlobe by a user wishing to insert an earring in the earlobe. The applicator comprises a protective pad configured to, when the applicator is positioned behind the earlobe, abut against the earlobe such that a post of an earring inserted through the earlobe will press against the protective pad. The applicator is thereby capable of reducing the likelihood of an earring post injuring a user.

The applicator may also be used for protecting a user when the user is inserting earring posts through a piercing.

Various possible embodiments of the applicator will now be illustrated with reference to FIGS. 5, 6 and 7.

The applicator illustrated in FIG. 5 comprises a graspable portion 11 and a surface 12 that has a plurality of raised bumps 13. Preferably, the surface 12, with its plurality of raised pumps 13, acts as a protective pad. The protective pad helps reduce the likelihood of an earring post injuring a user. Preferably the graspable portion 11 is used by the user to hold onto the applicator. Preferably the graspable portion 11 is arranged such that, when held by the user, at least part of the surface 12 comprising the plurality of raised bumps 13 can be positioned at the rear of the ear lobe.

The applicator illustrated in FIGS. 6 and 7 comprises a protective pad 14 for use in reducing the likelihood of a user injuring themselves with a earring post, and a mountable (or 'glove-like') portion 15 that allows the support device applicator to be mounted on at least one digit 17 of a user's hand.

Preferably the mountable portion 15 is made from a material that allows the applicator to be readily mounted onto the user's digit 17, The mountable portion 15 may be orientated such that at least part of a surface 16 of the protective pad 14 can be applied to the support device. Preferably, the protective pad surface 16 applied to the support device is substantially flat. Preferably, the protective pad 14 is made from at least two different materials: a deformable material and a less deformable material. The protective pad surface 16 may be at least partly made from the deformable material. This allows the protective pad surface 16 to deform on being pressed by the earring post. The material used for the portion of the protective pad closer to the user's digit is preferably the less deformable material. This affords a user's digit protection when inserting the earring post through a piercing. The protective pad 14 is preferably sized to cover a large proportion of a user's earlobe 1.

Preferably, the material of the applicator is one of the following: a plastic material, a fabric material, a gel-like material.

Preferably the support device applicator is configured to be more readily put onto the user's digit 17 than to be removed from the user's digit 17. This aids in reducing the likelihood of the applicator slipping off the user during use.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A method for transferring at least part of the weight of an earring from an earlobe of an ear to a part of the ear comprising cartilage, the method comprising the steps of:
- attaching an earring support device to the ear, such that:
  - a first portion of the earring support device is adjacent to an earlobe of the ear; and
  - a second portion of the earring support device is attached to cartilage of the ear, wherein the second portion is attached to the ear by adhering to an external surface of the ear using an adhesive; and
- securing an earring to the earlobe of the ear, such that:
  - a weight of the earring is at least partially supported by the earring support device; and
  - at least part of the weight of the earring is transferred by the earring support device from the earlobe to the cartilage of the ear.

2. The method of claim 1, wherein the first portion of the earring support device has a higher tensile strength than the second portion of the earring support device.

3. The method of claim 1, wherein the first portion is sized to cover one or more piercings in a user's earlobe.

4. The method of claim 1, wherein the first portion comprises a preformed hole that is aligned with at least one piercing on the user's ear.

5. The method of claim 4, wherein the preformed hole has a diameter less than 1 mm.

6. The method of claim 1, wherein the first portion is formed of a material capable of being pierced by an earring post as a user inserts an earring into their earlobe.

7. The method of claim 1, wherein the second portion of the earring support device is substantially elongate and has a convex surface and a concave surface.

8. The method of claim 1, wherein the earring support device comprises an adhesive layer for attaching the first portion to the earlobe and the second portion to the part of the ear comprising cartilage.

9. The method of claim 1, wherein the first portion and the second portion are integrally formed.

10. A method for transferring at least part of the weight of an earring from an earlobe of an ear to a part of the ear comprising cartilage, the method comprising the steps of:
- attaching an earring support device to the ear, such that:
  - a first portion of the earring support device is adjacent to an earlobe of the ear; and
  - a second portion of the earring support device is attached to cartilage of the ear, wherein the earring support device is attached to the ear by inserting the earring support device internally into the ear of the user via a surgical procedure; and
- securing an earring to the earlobe of the ear, such that:
  - a weight of the earring is at least partially supported by the earring support device; and
  - at least part of the weight of the earring is transferred by the earring support device from the earlobe to the cartilage of the ear.

11. The method of claim 10, wherein the first portion of the earring support device has a higher tensile strength than the second portion of the earring support device.

12. The method of claim 10, wherein the first portion is sized to cover one or more piercings in a user's earlobe.

13. The method of claim 10, wherein the first portion comprises a preformed hole that is aligned with at least one piercing on the user's ear.

14. The method of claim 13, wherein the preformed hole has a diameter less than 1 mm.

15. The method of claim 10, wherein the first portion is formed of a material capable of being pierced by an earring post as a user inserts an earring into their earlobe.

16. The method of claim 10, wherein the second portion of the earring support device is substantially elongate and has a convex surface and a concave surface.

17. The method of claim 10, wherein the first portion and the second portion are integrally formed.

* * * * *